US005165601A

United States Patent [19]

Rodenberger et al.

[11] Patent Number: 5,165,601

[45] Date of Patent: Nov. 24, 1992

[54] NOZZLE FOR LOW RESISTIVITY FLOWABLE MATERIAL

[75] Inventors: Phillip R. Rodenberger, Muncie; Bruce A. Hunnicutt, Anderson, both of Ind.

[73] Assignee: Terronics Development Corporation, Elwood, Ind.

[21] Appl. No.: 507,476

[22] Filed: Apr. 11, 1990

[51] Int. Cl.[5] ..... B05B 5/02

[52] U.S. Cl. ..... 239/3; 239/690; 239/695; 239/706; 239/600; 239/601

[58] Field of Search ..... 118/629; 239/601, 590, 239/596, 600, 3, 690, 695, 697, 704, 706

[56] References Cited

U.S. PATENT DOCUMENTS

| | | | |
|---|---|---|---|
| 1,060,089 | 4/1913 | Higgins | 239/601 |
| 3,198,442 | 8/1965 | Brenner | 239/601 |
| 4,095,962 | 6/1978 | Richards | 239/3 |
| 4,431,137 | 2/1984 | Prewett et al. | 239/590 |
| 4,749,125 | 6/1988 | Escallon et al. | 239/3 |
| 4,776,515 | 10/1988 | Michalchik | 239/3 |
| 4,801,086 | 1/1989 | Noakes | 239/3 |
| 4,830,872 | 5/1989 | Grenfell | 239/3 |
| 4,887,545 | 12/1989 | Soininen | 239/590 |
| 4,962,891 | 10/1990 | Layden | 239/590 |

FOREIGN PATENT DOCUMENTS 2707218 11/1978 Fed. Rep. of Germany .

*Primary Examiner*—Andres Kashnikow
*Assistant Examiner*—Christopher G. Trainor
*Attorney, Agent, or Firm*—Lundy & Associates

[57] ABSTRACT

In the broader aspects of the invention there is provided an improved nozzle, an improved nozzle assembly and an improved method in which the improved nozzle comprises a protrusion having an distal end and a collar extending backward from the distal end. The collar is surface free of discontinuities. The outer end has an edge and an adjacent point at which the charge is concentrated. The protrusion has a fluid passage. The fluid passage is sealed from the collar surface. The fluid passage has an outlet adjacent the edge. A conductor is disposed in the protrusion. The conductor extends into the passage and is immersed in the fluid being disposed.

41 Claims, 3 Drawing Sheets

NOZZLE FOR LOW RESISTIVITY FLOWABLE MATERIAL

BACKGROUND OF THE INVENTION

The present invention pertains to electrostatic fluid dispensing apparatus and more particularly pertains to electrostatic spray nozzles, nozzle assemblies and methods of electrostatic spraying.

In electrostatic fluid dispensing apparatus, a small amount of fluid is electrostatically charged and controllably dispensed in one or more ligaments, jets or streams or paths of droplets or other fluid paths. The term "fluid" is used herein to refer to liquids and to other flowable materials and to other materials made flowable by the applications of heat and/or pressure. The term "fluid paths" is used herein to refer broadly to ligaments, jets and streams and other continuous or discontinuous paths of fluid.

Previous electrostatic spray nozzles with a single point, for production of a single jet, are typically in the form of an electrified capillary, for example Winston, U.S. Pat. No. 3,060,429. In these nozzles, fluid is introduced through a small capillary port, typically about 0.001 inches in diameter, at a pressure which in itself is insufficient to produce flow. By imposing an electric field between the extremity of the nozzle and a conductive, nearby (typically one-quarter inch distant) substrate, a small jet of charged liquid can be forced to fire. Electrodes placed adjacent to the jet's path can impress a field and steer the jet.

This kind of nozzle has a rapid response time and is therefore widely used in high speed printing. These nozzles have limited usefulness in other applications due to the shortcomings of extremely limited throughput flow rates, limited resistivity and viscosity ranges of materials that can be fired, and required close positioning to substrates.

Prior nozzles generally, both single jet and multi-jet, also have a variety of other shortcomings. Nozzles having small orifices tend to clog with foreign matter, are difficult to fabricate in very small diameters and are subject to rapid wear due to local abrasion. Such nozzles may also not be operable with all flowable materials which may range from liquids to gels, from pure materials to suspensions of flowable material and foreign matter, and have a wide range of resistivities and viscosities.

Apparatus using mechanical and aerodynamic dropletization present difficulties as to high energy requirements and overspraying problems.

Another problem for electrostatic dispensing apparatus is the difficulty in providing a high percentage of the theoretical electrostatic charge limit, referred to as the Rayleigh Charge, on droplets or flow paths of a wide range of sizes.

The multi-point nozzle found in Escallon, et al U.S. Pat. No. 4,749,125 obviates the need for small orifices and has found many useful applications in areas as diverse as high speed metal lubrication and placing chemical treatments on foodstuffs or plants. Such nozzles, with the pure direct current power sources, are useful with throughput materials having resistivities down to about $10^6$ ohm-centimeters. Below that value, however, a marked decrease of particle number generation occurs, as a few oversized particles dominate the output. Since many useful throughput materials lie below this resistivity, including emulsions, alchohols, glycerins and other water based mixtures, there is a need for a nozzle design whose resistivity limits for good output characteristics are lower. Further, dilute water based mixtures pose additional difficulties due to their high surface tension. Pure water has a surface tension which does not lend itself to proper electrical atomization. The nozzles in Escallon, et al have electrodes that are relatively complex in shape, due to their use as both hydraulic and electrification elements, that must be accurately positioned for proper electrification of less conductive or more resistive throughput materials.

It is therefore highly desirable to provide an improved nozzle, an improved nozzle assembly and an improved method.

It is also highly desirable to provide an improved nozzle, an improved nozzle assembly and an improved method which facilitates the dispensing of controlled amounts of fluid in a single fluid path.

It is also highly desirable to provide an improved nozzle, an improved nozzle assembly and an improved method which do not utilize a small aperture or aerodynamic dropletization.

It is also highly desirable to provide an improved nozzle, an improved nozzle assembly and an improved method, which have a high throughput rate, do not require close positioning to the target and yet provide a uniform and stable output over a broad range of resistivities and viscosities and surface tension.

It is also highly desirable to provide an improved nozzle, an improved nozzle assembly and an improved method in which electrostatic characteristics are such that a high percentage of the theoretical charge limit can be imposed.

It is also highly desirable to provide an improved nozzle, an improved nozzle assembly and an improved method in which uniformly charged droplets of uniform size may be dispensed using direct current at low throughput resistivities and high flow rates.

It is also highly desirable to provide an improved nozzle, an improved nozzle assembly and an improved method in which the nozzle has a simple electrode and dimensional element.

It is also highly desirable to provide an improved nozzle, an improved nozzle assembly and an improved method for dispensing a wide variety of flowable materials ranging from liquids to gels including flowable materials with suspensions of foreign materials.

It is finally highly desirable to provide an improved nozzle, an improved nozzle assembly and an improved method which meet all of the above desired features.

SUMMARY OF THE INVENTION

It is an object of the invention to provide an improved nozzle, an improved nozzle assembly and an improved method.

It is also an object of the invention to provide an improved nozzle, an improved nozzle assembly and an improved method which facilitates the dispensing of controlled amounts of fluid in a single fluid path.

It is also an object of the invention to provide an improved nozzle, an improved nozzle assembly and an improved method which do not utilize a small aperature or aerodynamic dropletization.

It is also an object of the invention to provide an improved nozzle, an improved nozzle assembly and an improved method, which have a high throughput rate, do not require close positioning to the target and yet provide a uniform and stable output over a broad range of resistivities and viscosities and surface tensions.

It is also an object of the invention to provide an improved nozzle, an improved nozzle assembly and an improved method in which electrostatic characteristics are such that a high percentage of the theoretical charge limit can be imposed.

It is also an object of the invention to provide an improved nozzle, an improved nozzle assembly and an improved method in which uniformly charged droplets of uniform size may be dispensed using current at low throughput resistivities and high flow rates.

It is also an object of the invention to provide an improved nozzle, an improved nozzle assembly and an improved method in which the nozzle has a simple electrode and dimensional element.

It is also an object of the invention to provide an improved nozzle, an improved nozzle assembly and an improved method for dispensing a wide variety of flowable materials ranging from liquids to gels including flowable materials with suspensions of foreign materials.

It is finally an object of the invention to provide an improved nozzle, an improved nozzle assembly and an improved method which meet all of the above desired features.

In the broader aspects of the invention there is provided an improved nozzle, an improved nozzle assembly and an improved method in which the improved nozzle comprises a protrusion having a distal end and a collar extending backward from the distal end. The collar is surface free of discontinuities. The outer end has an edge and an adjacent point at which the charge is concentrated. The protrusion has a fluid passage. The fluid passage is sealed from the collar surface. The fluid passage has an outlet adjacent the edge. A conductor is disposed in the protrusion. The conductor extends into the passage and is immersed in the fluid being disposed.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein:

FIG. 7A is a top plan view of a lower subunit. FIG. 7B is a top plan view of an upper subunit. FIG. 7C is a top plan view of alternate upper subunit. FIG. 7D is a top plan view of a shim. FIG. 7E is a top plan view of an alternate shim. FIG. 7F is a top plan view of yet another alternate shim. FIG. 7G is a top plan vie of the fasteners of the kit.

DESCRIPTION OF A SPECIFIC EMBODIMENT

Figure 1:
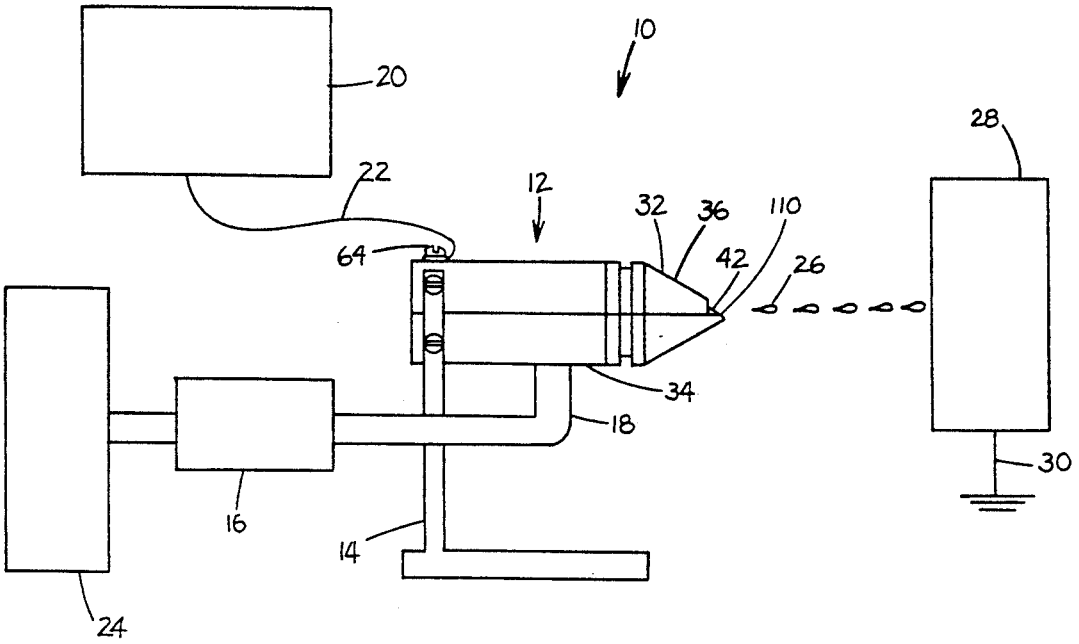
FIG. 1 is a diagramatic view of a dispensing assembly including the nozzle of the invention.

Referring now to FIG. 1, the dispensing assembly 10 of the invention includes the nozzle 12 of the invention, a nozzle support 14, a fluid reservoir 16, a fluid duct 18, a high voltage power supply 20 and conductor 22, and a hydrostatic control 24. Fluid path 26 is directed from nozzle 12 to the proximity of target 28, which may be electrically biased and may, for example, be grounded by ground line 30. A fluid is provided by reservoir 16 through fluid duct 18 to nozzle 12 at a selected hydrostatic pressure ranging from atmospheric pressure to elevated pressures. The fluid pressure is controlled by hydrostatic control 24, and is in all cases below that necessary to force or squirt the fluid from nozzle 12 without the imposition of an electrical charge.

Figure 2:
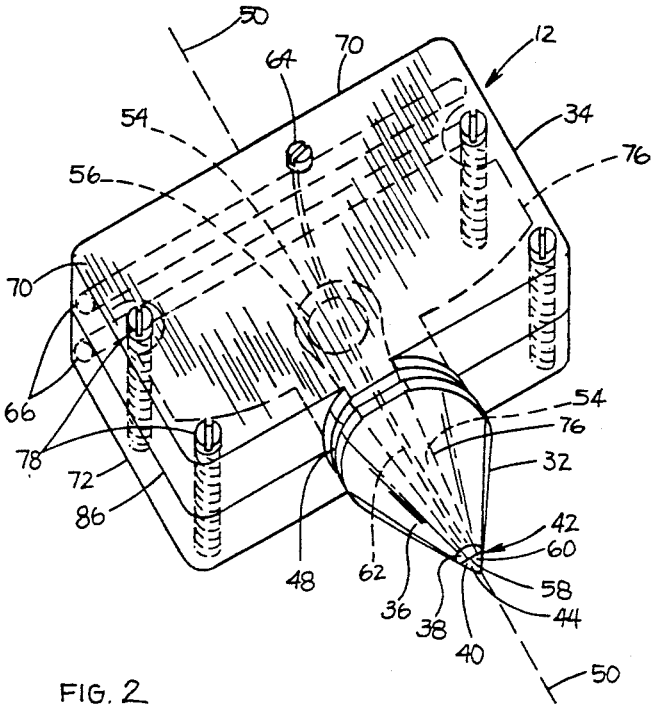
FIG. 2 is a perspective view of an embodiment of the nozzle of the invention. The locations of the shim, conductor, fluid port, concealed portions of the conductor terminal, fasteners and attachment recesses are shown by dashed lines.
Figure 3:
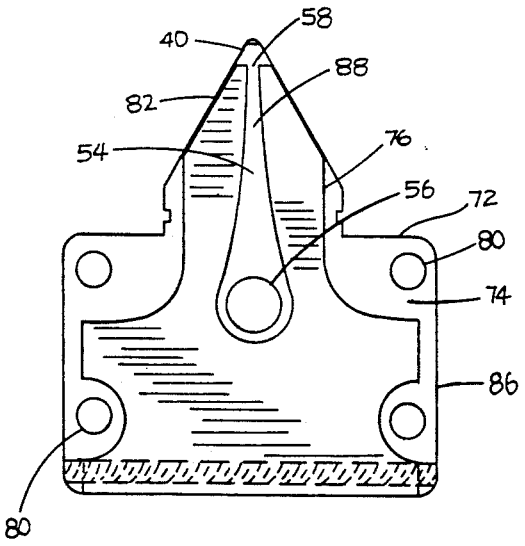
FIG. 3 is a top plan view of the lower subunit of the nozzle of FIG. 1, including the shim and lower member. The location of one of the attachment recesses is shown by dashed lines.
Figure 4:
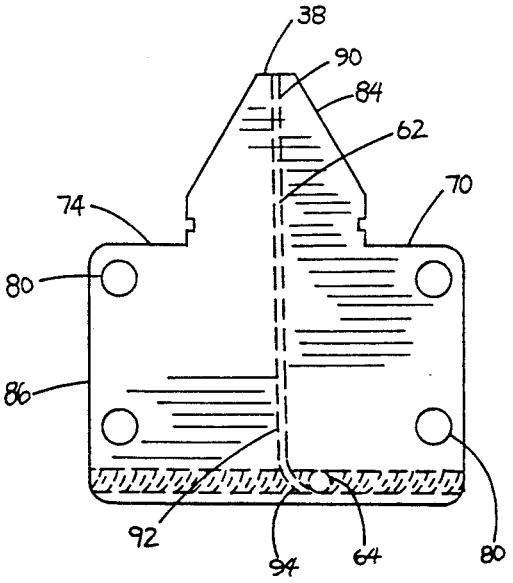
FIG. 4 is a bottom plan view of the upper subunit of the nozzle of FIG. 1, including the conductor, conductor terminal and upper member. The locations of concealed portions of the conductor, the conductor terminal and one of the attachment recesses are shown by dashed lines.

Referring now to FIGS. 2, 3 and 4, the nozzle 12 of the invention is shown. Nozzle 12 has a forwardly protruding front portion 32 and a rear portion 34. Front portion 32 has a main exterior surface 36, which is smoothly curved, from front to back, and first and second notch surfaces 38, 40 which define a notch 42. Nozzle 12 is shaped so as to concentrate charge at tip 44 of front portion 32. For example, front portion 32 may have generally the shape of a notched circular cone and rear portion 34 adjoining front portion 32.

In particular embodiments of the invention, front portion 32 has generally the shape of a notched, sixty degree, right circular cone. In particular embodiments of the invention, first notch surface 38 is substantially perpendicular to both second notch surface 40 and to longitudinal axis 50 of front portion 32. Both notch surfaces 38, 40 are substantially planar. The separation of apex or tip 44 and first notch surface 38 may vary between about 0.010 inches or 0.254 millimeters and about 0.25 inches or about 6.35 millimeters. In the embodiment illustrated in FIG. 2, the axial length of front portion 32 is at least four times larger than the axial length o notch surface 40.

A fluid passage 54 extends from a fluid port 56, through rear portion 34 and front portion 32 to an outlet 58 at the inner margin 60 of notch 42. Fluid port 56 is adapted to receive fluid duct 18, for example, by being reciprocally threaded. In contact with fluid passage 54 adjacent inner margin 60, is an electrode 62, which extends back through nozzle 12 to an electrode terminal 64 in rear portion 34 of nozzle 12. The entire length of this electrode 62 is either encapsulated in rear portion 34 or immersed in the fluid being dispensed. In the embodiment of the invention shown in the figures, electrode 62 is a length of wire and terminal 64 is a metal bolt engaging reciprocal threads of a subunit, however, more complex configurations of terminal 64 and electrode 62 may be substituted. With the exception of electrode 62 and terminal 64, which are made of an electrically conductive material such as metal, nozzle 12 is made of electrically insulating materials such as plastic or ceramic materials. Nozzle 12 may include an insulating guard, not shown, to cover terminal 64 and prevent arcing to target 28.

Nozzle 12 may be attached to nozzle support 14 by means of threaded recesses 66 and reciprocal fasteners (not shown) or by other means.

The nozzle 12 is divided longitudinally into upper and lower subunits 70, 72. Subunits 70, 72 have inner faces 74, which are complementary in shape and preferably are both essentially planar. Between faces 74, is positioned a thin shim 76 of essentially uniform thickness non-conductive material such as plastic sheet material. Upper and lower subunits 70, 72 are joined tightly together, with shim 76 in between, by bolts 78 engaging reciprocally threaded recesses 80 extending through subunits 70, 72. By this means subunits 70, 72 are joined tightly together, with shim 76 in between. In particular embodiments of the nozzle 12 of the invention, shim 76 may vary in thickness between about 1 mil and about 20 mils or between about 0.025 millimeters and about 0.408 millimeters.

In a particular embodiment of nozzle 12 of the invention, front portion 32 is divided between subunits 70, 72 such that a lower part 82 of front portion 32 has essentially the shape of half of a cone bisected by a plane parallel to axis 50 and a part 84 of front portion 32 has essentially the shape of half of a frustum bisected by a plane parallel to axis 50. In that embodiment of the nozzle 12 of the invention, first notch surface 38 is on upper subunit 70 and second notch surface 40 is on lower subunit 72.

In front portion 32 of nozzle 12, shim 76 and inner faces 74 have essentially the same lateral dimensions. Subunits 70, 72 thus join in front portion 32, at a smooth margin 86, within which shim 76 fills or essentially fills any gap between subunits 70, 72 but does not extend laterally outward beyond subunits 70, 72.

Main exterior surface 36 of front portion 32 is thus essentially continuously curved, essentially free of discontinuities and free of edges between rear portion 34 and notch 42. In rear portion 34, shim 76 may be inset laterally from margin 86 and from bolts 78 and recesses 80.

Shim 76 has a slot 88, which together with inner faces 74, defines fluid passage 54. The size of passage 54 is determined by the size of slot 88 and by the thickness of shim 76. In the embodiment illustrated, behind outlet 58, slot 88 has a nearly constant width and then expands to encircle port 56. Electrode 62 has a front section 90 disposed within slot 88 and immersed in the fluid being disposed behind outlet 58, a rear section 92 encapsulated or encased within one of subunits 70, 72 and a terminal section 94 engaging electrode terminal 64.

Figure 5:
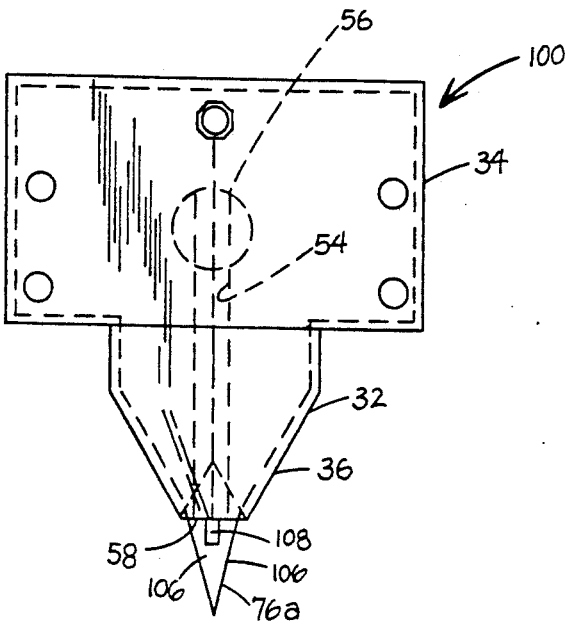
FIG. 5 is a top plan view of a modified version of the nozzle of FIG. 1 which has particular usefulness with flowable materials of high surface tension. The locations of the shim, conductor, fluid port, concealed portions of the conductor terminal, fasteners and attachment recesses are shown by dashed lines.
Figure 6:
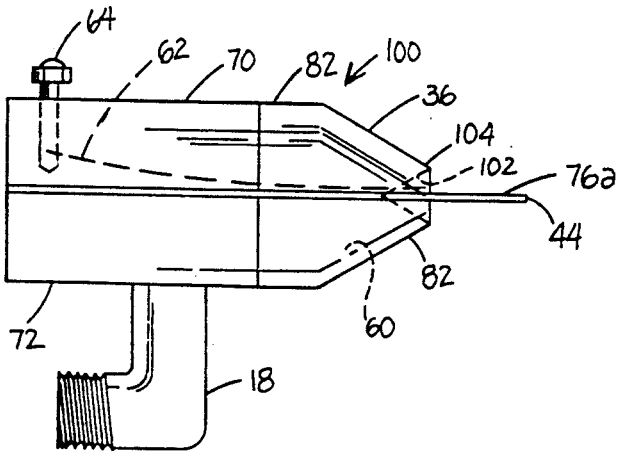
FIG. 6 is a side plan view of the nozzle of FIG. 5. The locations of the shim, conductor, fluid port, concealed portions of the conductor terminal, fasteners and attachment recesses are shown by dashed lines.

Referring now to FIGS. 5 and 6 a modified nozzle 100 having particular usage for dispensing flowable materials having low resistivities and high surface tensions is shown. Nozzle 100 has essentially the same structure as nozzle 12 above-described. Like reference numerals are used to denote like structure in all Figures. Letters, i.e., "a", are used to refer to like but modified structure. In a specific embodiment, the only distinction between Nozzle 100 and Nozzle 12 is adjacent distal end or tip 44.

In Nozzle 100, instead of notch surfaces 38, 40, a reversely extending conical surface 102 is positioned coaxially of exterior surface 36. The apex of conical surface 102 terminates at outlet 58 of fluid passage 54. Conical surface 102 and exterior conical surface 36 define a circular distal edge 104. Shim 76*a* in nozzle 100 extends from front portion 32 and fluid outlet 58 beyond edge 104 to form the apex of tip or distal end 44. Shim 76*a* adjacent tip or distal end 44 is conically shaped to define with exterior surface 36 a cone as above-described.

In a specific embodiment the outer edges 106 of shim 76*a* exterior of edge 104 may have an accurate shape which extends inwardly toward each other to define an extended and sharper distal end or tip 44 than with a straight conically shaped shim. This shape allows for liquids having extremely high surface tensions, such as water, to have its charge concentrated at tip 44 by each edge defining a meniscus which extends inwardly toward each other and toward point tip and distal end 44.

In a specific embodiment, edge 104 is sharp and with tip 44 concentrates the charge at tip 44 and edge 104. In this embodiment, an electric field, circular in shape, of the same charge as the fluid being dispensed is formed by edge 104. At design flows, a meniscus forms between the inner surface or reversely extending conical surface 102 and tip 44. This field has the tendency to force the fluid path into a narrower, more defined pattern.

Nozzle 100 is utilized with liquids having a sufficiently high surface tension to form a convesly shaped meniscus on notch 38, 40 which does not properly concentrate the charge at and distal end 44. When dispensing such liquids, a bulbus meniscus is formed from surfaces 34, 40 which errant unstable ligaments in a variety of directions may erupt. Nozzle 100 stabilizes the ligament position with such fluids.

In both nozzle 100 and nozzle 12 the throughput of the nozzle with a stable ligament position is dependent upon the formation of a meniscus allowing for the concentration of charge at tip 44. Nozzle 100 for highly flowable fluids having high surface tensions has throughputs of up to three times of those of nozzle 12 and permits dispensing flowable materials having one-half the resistivities of nozzle 12. In both nozzle 12 and nozzle 100, the size of fluid passages 54 is sufficiently large as to be not controlling of the throughput of the nozzle.

In a specific embodiment of nozzle 100 as shown in FIGS. 5 and 6, shim 76*a* is shown to have exterior of edge 104 and between its opposite sides 106, an opening 108. This opening 108 allows for the fluid on opposite sides of the shim to be in communication and stabilizes the opposed meniscus on one side of the shim with the opposed meniscus on the other side of the shim.

Figure 7:
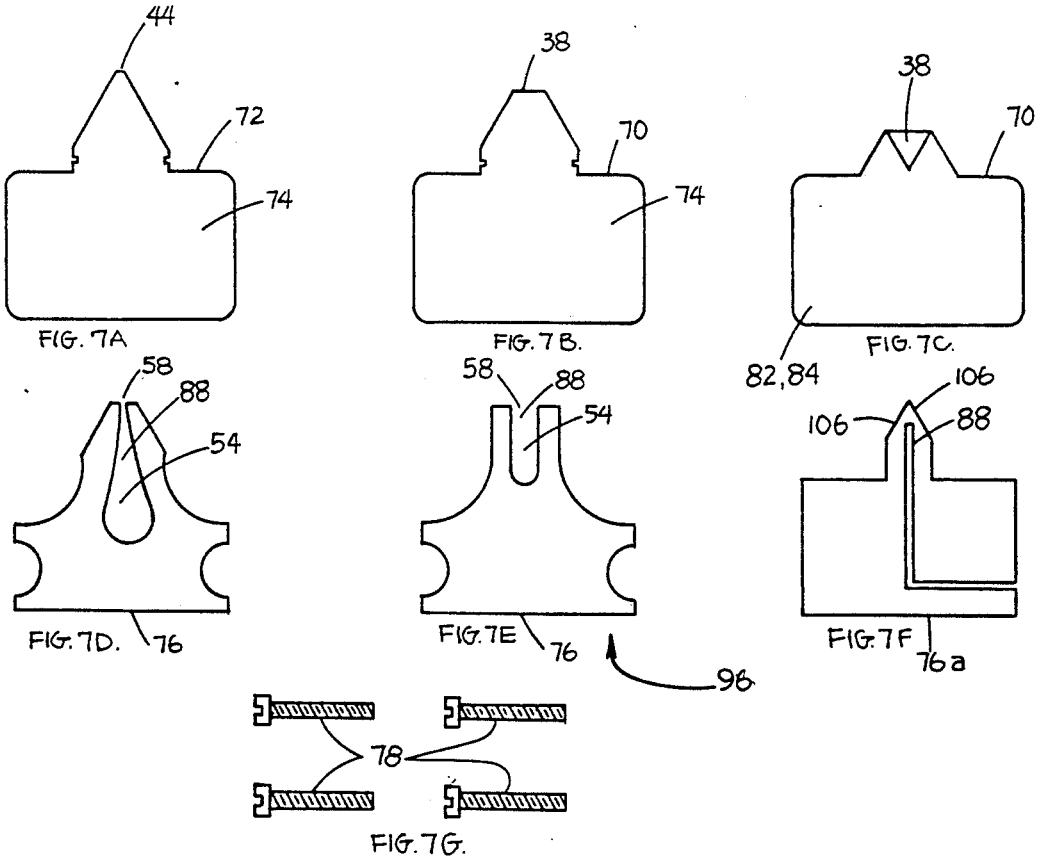
FIG. 7 is a top plan view of the kit of the invention including upper and lower subunits, shims and fasteners.

Referring now to FIG. 7, the kit 96 of the invention includes an upper subunit 70 or 70*a*, a lower subunit 72 or 72*a*, a shim 76 or 76*a* and bolts 78, which may be assembled into either nozzle 12 or 100 of the invention. Preferred embodiments of kits 96 of the invention include a variety of shims 76 or 76*a*, which vary in thickness and shape and additional upper subunits 70 or 70*a* and lower subunits 72 or 72*a* which vary as to the separation of first notch surface 38 and edge 104 from tip 44, and the angular relation of surfaces 36 and 102. In these embodiments, a nozzle 12 can be assembled so as to vary the applicability of the nozzles of the invention to most flowable fluids have resistivities below about $10^5$ ohm-centimeters irrespective of their surface tensions.

Figure 8:
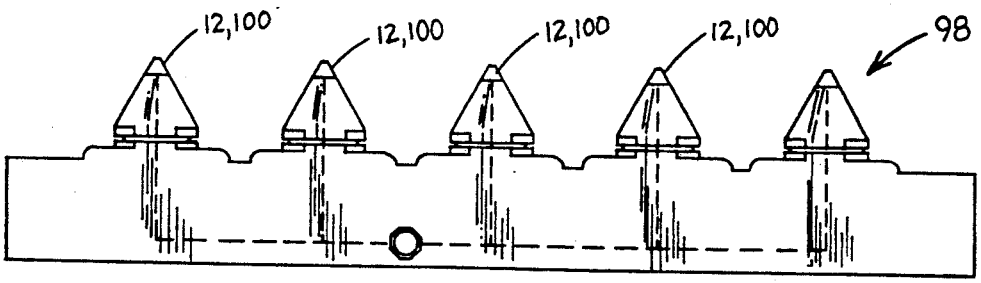
FIG. 8 is a top plan view of a multiple nozzle assembly of the invention having a plurality of nozzles as shown in FIGS. 2 through 4 or 5 and 6.

Referring now to FIG. 8, in the multiple nozzle assembly 98 of the invention is shown having a plurality of nozzles 12 or 100 of the invention arranged together in an array having a linear form. In other specific embodiments the plurality of nozzles may be arranged in a circular or other form. If such a multiple nozzle assembly 98 is to be used with certain conductive fluids, such as isopropyl alcohol, it is necessary that tips 44 of neighboring nozzles 12 be separated by at least about one-quarter inch or 6.35 millimeters to lessen the space charge interference between tips 44. More conductive liquids may require tip spacing as large as about three inches or about 76.2 millimeters.

In accordance with the invention, fluid path 26 may be aimed at a target 28, or may be kept from impact by air flow or gravity or electric means. Droplets of a Predetermined size may be created, charged and removed from the immediate nozzle area for disposition elsewhere. Droplets may also be formed of hot melt materials and cooled to form uniform spherical particles. Target 28 may be of a wide variety of materials including: free space, metallic, wood, paper, glass, plastics, organic materials such as plants and foodstuffs; in a multitude of forms, such as webs, sheets, filaments, loose objects, etc. In general, there are no limitations as to target material or forms except the target 28 must have capacitance or grounding. Electrical characteristics of fluids that may be used have resistivities from about $10^5$ to about $10^{12}$ ohm-centimeters, viscosities from less than about 1.0 to about $10^5$ centipoise as measured on a Wells-Brookfield micro viscometer, with a titanium spc-31.565cone and surface tensions from about 20 to about 80 dynes per centimeter.

Very small static pressures and low electrical energies are used in this apparatus. Typical values are less than about 1 psig and about 15 KV direct current.

In operation, a fluid is conducted through fluid passage 54 and past charged electrode 62 to outlet 58 at which meniscus 110 forms. The geometry of meniscus 110, is controlled so as to permit dispensing a selected fluid in a controlled manner, by appropriate selection of notch 42, edge 104 and outlet 58 sizes.

As the flow rate and surface tension rise in fluids dispensed with nozzle 12, the meniscus formed may change from a concave to a convex shape. This change in meniscus shape may result in the charge not being concentrated at tip 44 and may cause sporadic ligament formation and positioning. By changing from nozzle 12 to nozzle 100 such fluids may be controllably disbursed by reshaping the meniscus. By edge 104 and shim **76*a*, the meniscus of such fluids is reshaped to a concaved shape extended between interior surface 102 and tip 44**. With such a meniscus geometry, controlled dispensing is accomplished even with high surface tension fluids.

When a high voltage is applied to electrode 62, charge is concentrated immediately adjacent to and forward of outlet 58, by the shape of the meniscus formed by front portion 32. Non-conductive shim 76 eliminates possible ionization losses to the sides. Essentially, stationary fluid flow at meniscus 110 is accelerated rapidly into space, as a fluid path 26, by the local field and local charge on the fluid, toward target 28. The shape of front portion 32 allows for nearly all of the charge to concentrate at tip 44 as there is no competing edges or structure in the near vicinity of tip 44. By the nozzle structure of the invention, a high percentage of the theoretical charge limit can be imposed and a high throughput of a wide range of flowable materials can be dispensed in uniformly charged and sized droplets without much regard for resistivities, surface tension and fluid impurities.

In another particular embodiment of the method of the invention, the nozzle and outlet 58 size appropriate for a particular fluid are selected and nozzle 12 or 100 is assembled from subunits 70, **70*a*, 72, 72*a* and shim 76, 76*a* before use. As a general but not universal rule, the higher the surface tension and viscosity of a fluid, the larger the outlet 58**.

To specifically illustrate the novelty and usefulness of the nozzles 12 and 100 of the invention, it can be shown that the nozzle of U.S. Pat. No. 4,749,125 issued to Escallon, et al cannot controllably dispense either isoprophyl alcohol or distilled and deionized water. However, a nozzle 12 having the shape of a 60° right circular cone with a base diameter of about three-quarter inches and a notch 40 approximately two-tenths to 0.25 inches from tip 44 controllably dispenses isopropyl alcohol with a throughput rate of about 1 to about 2 millimeters per minute with uniform ligament formation and positioning in a controllable manner. The same nozzle, however, is not useful to dispense distilled and deionized water above a rate of about 2 millimeters per minute. However, nozzle 100 having the shape of a 60° right circular cone with edge 104 being located about 0.4 to 0.6 inches from tip 44 and a shim **76*a*** of about 0.003 to about 0.010 inch thickness successfully dispenses water at a flow rate of about 8.0 millimeters per minute with a continuous and stable ligament in both formation and positioning in a controlled manner.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A nozzle for electrostatically dispensing flowable material, comprising a nozzle body having front and rear portions, said front portion having an apex at a distal end and first and second notch surfaces adjacent to said apex and a smoothly rounded front portion surface extending rearwardly from said apex towards said rear portion, said front portion surface being substantially free of edges and converging toward said apex to concentrate an electrical charge at said apex, said front portion having a fluid passage therein, said fluid passage being sealed from said front portion surface, said fluid passage having an outlet adjoining said notch surfaces, and an electrode disposed in said passage.

2. The nozzle of claim 1 wherein said front portion has an axis extending through said apex, said first notch surface being disposed perpendicularly to said axis and in spaced relations to said apex.

3. The nozzle of claim 1 wherein said front portion has substantially the shape of a notched cone.

4. The nozzle of claim 1 wherein said front portion has substantially the shape of a notched, right circular cone.

5. The nozzle of claim 1 wherein said second notch surface is substantially perpendicular to said first notch surface.

6. The nozzle of claim 1 wherein said first and second notch surfaces are each substantially planar.

7. The nozzle of claim 1 wherein said nozzle has separable upper and lower subunits.

8. The nozzle of claim 7 further comprising a slotted shim disposed between said subunits, said shim slot and said subunits together defining said passage.

9. The nozzle of claim 8 wherein said shim and both said subunits are of insulative, electrically non-conducting material.

10. The nozzle of claim 8 wherein said shim is totally within the boundaries of said front and rear portion.

11. The nozzle of claim 1 wherein said front portion has an axis extending through said apex, said first notch surface is disposed perpendicular to said axis and spaced from said apex, said second notch surface being substantially perpendicular to said first notch surface and extending from said first notch surface to said apex, both said first and second notch surfaces being substantially planar.

12. The nozzle of claim 2 wherein the distance between said first notch surface and the distal end of said nozzle is less than one quarter of the length of said nozzle front portion in the same direction.

13. A nozzle for electrostatically dispensing a flowable material, said nozzle comprising an upper subunit and a lower subunit, said subunits being joined together, said subunits together defining a front portion and a rear portion, said front portion having an exterior surface generally the shape of a cone with an apex at a distal end and a longitudinal axis extending through said apex, said subunits each having a notch surface, said external conical surface converging toward said apex to concentrate a charge at said apex, the axial length of said front portion being greater than four times the axial length of said notch surfaces, said subunits defining a fluid passage, said fluid passage having an outlet adjoining said notch surfaces, and an electrode having a front section disposed in said fluid passage.

14. A kit and nozzle for electrostatically dispensing a flowable material, said kit comprising an upper subunit, a lower subunit, a shim and an electrode, said subunits and said shim being reversibly joinable together with said shim between said subunits to define a front portion and a rear portion and a fluid passage therein, said front portion being generally the shape of a notched cone having an apex at a distal end, said subunits having first and second notch surfaces adjacent to said apex and a front portion exterior generally conical surface extending backwardly away from said apex toward said rear portion and converging toward said apex, the length of said front portion measured from said apex to said rear portion being greater than four times the length of said notch surfaces measured in the same direction, said front portion surface being substantially free of edges, said shim having a slot therein defining with said subunits said fluid passage, said fluid passage having an outlet adjoining said notch surfaces, said electrode having a front section disposable in said fluid passage.

15. A multiple nozzle assembly comprising a frame and a plurality of nozzles joined to said frame in an array, each of said nozzles including a front portion extending outwardly of said frame, said front portions each having a notch surface and a smoothly rounded exterior surface extending backwardly toward said frame, each said nozzle having an apex at a distal end, said exterior surfaces converging toward said apices to concentrate an electrical charge at said apices, the length of said front portion surface measured int eh direction between said apices and said frame is greater than about four time the length of said notch surface int eh same direction, said exterior surfaces being substantially free of edges, said front portions having a fluid passage therein, said fluid passages being sealed from said exterior surfaces, said fluid passages having an outlet adjoining said notch surfaces, and an electrode disposed in each of said passages.

16. The multiple nozzle assembly of claim 15 wherein said array is circular.

17. The multiple nozzle assembly of claim 15 wherein said array is linear.

18. The multiple nozzle of claim 15 wherein neighboring said nozzles are separated by at least about one-quarter inch.

19. A nozzle assembly comprising a nozzle, a fluid reservoir supplying fluid to said nozzle, and a high voltage power supply, said nozzle including a front portion having an apex at a distal end and a notch surface adjacent to said apex and a smoothly rounded exterior surface extending backwardly away from said apex, said exterior surface converging toward said apex to concentrate a charge at said apex, the length of said front portion measured in the direction of the extension of said exterior surface being at least four times larger than the length of said notch surface measured in the same direction, said exterior surface being substantially free of edges, said front portion having a fluid passage therein, said fluid passage being in communication with said reservoir, said fluid passage having an outlet adjoining said notch surface, and an electrode disposed in said passage and being electrically connected to said high voltage supply.

20. A method of dispensing flowable material through a nozzle comprising the steps of supplying a flowable material to a passage within a nozzle, conducting said material into electrically conducting contact with an electrode, delivering said material to an outlet for formation of a meniscus, controlling the geometry of said meniscus, controlling the spatial separation of said meniscus and a single apex forward of said meniscus by controlling the distance between said apex and a notch surface, concentrating an electrical charge immediately adjacent to and forward of said meniscus by smoothly tapering the external surface of said nozzle toward said apex and eliminating all edges on said surface, and connecting said electrode to a high voltage source to charge said flowable material and to accelerate said flowable material at said meniscus rapidly into space as a charged fluid path, by the local field and local charge on the fluid, thereby causing said flowable material to travel forward to a target.

21. The method of claim 20 further comprising the step of controlling the pressure of said material within said passage other than by charge on said material.

22. A nozzle for electrostatically dispensing flowable material, comprising a nozzle body having front and rear portion, said front portion having a fluid passage therein and front portion interior and exterior surfaces and a distal end, said front portion surfaces extending rearwardly from adjacent said distal end toward said rear portion, said front portion exterior surface converging toward said distal end, said front portion interior surface converging away from said distal end and toward said fluid passage outlet, said front portion surfaces being substantially free of edges, said fluid passage being sealed from said front portion exterior surface, said fluid passage having an outlet adjoining said front portion interior surface, said front portion exterior and interior surfaces joining at an edge spaced from but adjacent to said distal end, said front portion exterior and interior surfaces at said edge being geometrically similar, and an electrode disposed in said passage.

23. The nozzle of claim 22 wherein said nozzle has separable upper and lower subunits.

24. The nozzle of claim 22 wherein said front portion surfaces are conical, said conical surfaces join at a circular edge.

25. The nozzle of claim 18 wherein a conical notch surface communicates with said passage at said apex thereof.

26. The nozzle of claim 19 wherein said shim extend outwardly form said front portion coaxially thereof.

27. The nozzle of claim 26 wherein said shim has a distal end with opposite sides, said sides being concavely shaped with regard to each other.

28. The nozzle of claim 26 wherein said shim is disposed between said subunits, said shim having an exterior portion defining the distal end of said nozzle, said shim having a slot communicating with the opposite sides of said shim exterior of said front and rear portion.

29. The nozzle of claim 28 wherein said rear portion has a fluid port and wherein said slot adjoining said port.

30. The nozzle of claim 29 wherein said shim is separable form both said subunits and exchangeable.

31. The nozzle of claim 23 further comprising a slotted shim disposed between said subunits, said shim slot and said subunits together defining said passage.

32. The nozzle of claim 23 wherein said shim and both said subunits are of insulative, electrically nonconducting material.

33. The nozzle of claim 23 wherein said rear portion has a fluid port and wherein said slot adjoins said port.

34. The nozzle of claim 33 wherein said shim is separable from both said subunits and exchangeable.

35. A nozzle for electrostatically dispensing a flowable material, said nozzle comprising an upper subunit and a lower subunit, said subunits being joined together, said subunits together defining a front portion and a rear portion, said front portion having a fluid passage therein and front portion interior and exterior surfaces and a distal end, said front portion surfaces extending rearwardly from adjacent said distal end toward said rear portion, said front portion exterior surface converging toward said distal end, said front portion interior surface converging away from said distal end and toward said fluid passage outlet, said front portion surfaces being substantially free of edges, said fluid passage being sealed from said front portion exterior surface, said fluid passage having an outlet adjoining said front portion interior surface, said front portion exterior and interior surfaces joining at an edge spaced from but adjacent to said distal end, said front portion exterior and interior surfaces at said edge being geometrically similar, and an electrode disposed in said passage.

36. A kit and nozzle for electrostatically dispensing a flowable material, said kit comprising an upper subunit, a lower subunit, a shim, and an electrode, said subunits and said shim being reversibly joinable together with said shim between said subunits to define a front portion and a rear portion and a fluid passage therein, said front portion having said fluid passage therein and front portion interior and exterior surfaces and a distal end, said front portion surfaces extending rearwardly from adjacent said distal end toward said rear portion, said front portion exterior surface converging toward said distal end, said front portion interior surface converging away from said distal end and toward a fluid passage outlet, said front portion surfaces being substantially free of edges, said fluid passage being sealed from said front portion exterior surface, said fluid passage having an outlet adjoining said front portion interior surface, said front portion exterior and interior surfaces joining at an edge spaced from but adjacent to said distal end, said front portion exterior and interior surfaces at said edge being geometrically similar, and an electrode disposed in said passage.

37. A multiple nozzle assembly comprising an frame and a plurality of nozzles joined to said ram in an array, each of said nozzle including a front portion extending outwardly of said frame, said front portions each having a fluid passage therein and front portion interior and exterior surfaces and a distal end, said front portion surfaces extending rearwardly form adjacent said distal end toward said rear portion, said front portion exterior surface converging toward said distal end, said front portion interior surface converging away from said distal end and toward said fluid passage outlet, said front portion surfaces being substantially free of edges, said fluid passage being sealed from said front portion exterior surface, said fluid passage having an outlet adjoining said front portion interior surface, said front portion exterior and interior surfaces joining at an edge spaced from adjacent to said distal end, said front portion exterior and interior surfaces at said edge being geometrically similar, and an electrode disposed in said passage.

38. The multiple nozzle assembly of claim 37 wherein said array is circular.

39. The multiple nozzle assembly of claim 37 wherein said array in linear.

40. The multiple nozzle of claim 37 wherein neighboring said nozzles are separated by at least about one-quarter inch.

41. A nozzle assembly comprising a nozzle, a fluid reservoir supplying fluid to said nozzle, and a high voltage power supply, said nozzle including a front portion having an apex at a distal end and a notch surface adjacent to said apex and a smoothly rounded exterior surface extending backwardly away from said apex, said exterior surface converging toward said apex to concentrate the charge at asia apex, the length of said front portion measured in the direction of the extension of said exterior surface being at least four times larger than the length of said notch surface measured in the same direction, said exterior surface being substantially free of edges, said front portion having a fluid passage therein and front portion interior and exterior surfaces and a distal end, said front portion surfaces extending rearwardly from adjacent said distal end toward said rear portion, said front portion exterior surface converging toward said distal end, said front portion interior surface converging away from said distal end and toward said fluid passage outlet, said front portion surfaces being substantially free of edges, said fluid passage being sealed from said front portion exterior surface, said fluid passage having an outlet adjoining said front portion interior surface, said front portion exterior and interior surfaces joining at an edge spaced from but adjacent to said distal end, said front portion exterior and interior surfaces at said edge being geometrically similar, and an electrode disposed in said passage.

* * * * *